US010982450B2

(12) United States Patent
Burnside et al.

(10) Patent No.: US 10,982,450 B2
(45) Date of Patent: Apr. 20, 2021

(54) RETRACTABLE FLOOR COVER

(71) Applicants: Charlie Burnside, Kent, WA (US); Karen Burnside, Kent, WA (US)

(72) Inventors: Charlie Burnside, Kent, WA (US); Karen Burnside, Kent, WA (US)

( * ) Notice: Subject to any disclaimer, the term of this patent is extended or adjusted under 35 U.S.C. 154(b) by 210 days.

(21) Appl. No.: 15/986,964

(22) Filed: May 23, 2018

(65) Prior Publication Data

US 2018/0340339 A1 Nov. 29, 2018

Related U.S. Application Data

(60) Provisional application No. 62/510,556, filed on May 24, 2017.

(51) Int. Cl.

| | |
|---|---|
| ***E04F 15/16*** | (2006.01) |
| ***A47C 31/10*** | (2006.01) |
| ***A47G 27/02*** | (2006.01) |

(52) U.S. Cl.

CPC ..... *E04F 15/16* (2013.01); *A47C 31/10* (2013.01); *A47G 27/0206* (2013.01)

(58) Field of Classification Search

CPC ..... A47C 31/10; A47G 27/0206; E04F 15/16
See application file for complete search history.

(56) References Cited

U.S. PATENT DOCUMENTS 1,950,927 A * 3/1934 McMillan ..... B60N 2/6009 296/181.4
2,177,174 A * 10/1939 Eccles ..... A47C 7/52 297/423.45
4,195,875 A * 4/1980 Venne ..... B60P 3/341 296/156
4,502,674 A * 3/1985 White ..... B60R 5/047 160/121.1
4,668,001 A * 5/1987 Okumura ..... B60R 5/047 248/268
4,671,557 A * 6/1987 Lemp ..... B60R 5/047 160/323.1
4,877,281 A * 10/1989 Altmann ..... B60R 5/04 296/39.1
4,991,789 A * 2/1991 Buerger ..... A47G 27/0287 242/390.8
5,083,831 A * 1/1992 Foyen ..... B60N 3/044 296/39.1

(Continued)

*Primary Examiner* — James M Ference
(74) *Attorney, Agent, or Firm* — Boudwin Intellectual Property; Daniel Boudwin

(57) ABSTRACT

A retractable floor cover. The device includes an elongated cylindrical housing and a flexible panel connected to a rotatable spool disposed within an interior volume of the housing, which is operably connected to a spring-rewind mechanism. The panel extends outwardly through a slot disposed on the housing, wherein the panel is configured to move between an extended position and a retracted position. A control disposed on the housing is configured to activate the spring-rewind mechanism, wherein activation of the spring-rewind mechanism is configured to roll the panel along the spool and retract the panel though the slot and into the interior volume of the housing. The housing can be integral to an article of furniture or may be secured to an existing article of furniture via a first strap disposed on a first end of the housing and a second strap disposed on an opposing second end of the housing.

1 Claim, 4 Drawing Sheets

(56) References Cited

U.S. PATENT DOCUMENTS 5,152,572 A * 10/1992 Ellis ..... B60N 3/044 296/39.1
5,425,691 A * 6/1995 Van Der Hoeven ..... A63B 23/0458 472/90
5,591,105 A * 1/1997 Dalebout ..... A63B 23/0458 482/52
5,618,077 A * 4/1997 Ament ..... B60R 5/047 160/121.1
6,125,908 A * 10/2000 Ament ..... B60R 5/047 160/323.1
6,148,456 A * 11/2000 Tharalson ..... A47C 29/003 5/11
6,280,817 B1 8/2001 McCrossin et al.
6,416,103 B1 * 7/2002 Laudenbach ..... B60R 5/047 160/290.1
6,659,551 B1 * 12/2003 Arenas ..... B60N 2/6027 160/23.1
7,013,505 B2 * 3/2006 Martin ..... A47D 7/02 5/95
7,178,851 B1 * 2/2007 Gridley ..... B60R 13/01 296/39.1
7,431,394 B2 * 10/2008 Neustat ..... A47C 7/72 297/218.2
7,597,373 B2 * 10/2009 McAuliffe, Jr. ..... B60R 13/011 296/39.1
7,677,624 B1 * 3/2010 Koski ..... B60J 7/085 296/1.07
7,967,387 B2 * 6/2011 Langhorn ..... A47D 11/02 297/423.25
8,215,577 B2 * 7/2012 Gordon ..... E01C 13/08 242/390.2
9,211,822 B1 * 12/2015 Blackledge ..... B60N 2/26
9,573,527 B2 * 2/2017 Murray ..... B60R 5/047
2002/0037387 A1 * 3/2002 Sweeney ..... A47D 15/00 428/43
2002/0071924 A1 * 6/2002 Lopez-Valverde ..... A47G 27/0206 428/40.1
2004/0041447 A1 * 3/2004 Tortorice ..... A47D 15/00 297/188.08
2004/0149397 A1 * 8/2004 Last ..... E04H 4/082 160/133
2004/0160075 A1 * 8/2004 Ehrenberger ..... B60R 5/047 296/37.1
2005/0218682 A1 * 10/2005 Klotz ..... B60R 5/04 296/39.1
2006/0071495 A1 * 4/2006 Steigerwald ..... B60R 5/047 296/24.4
2006/0232095 A1 * 10/2006 Sedighzadeh ..... B60J 11/02 296/98
2007/0044388 A1 * 3/2007 Lajoie ..... E04B 2/7416 52/64
2007/0044389 A1 * 3/2007 LaJoie ..... E04F 10/02 52/64
2008/0173411 A1 * 7/2008 Bernhardsson ..... B60R 5/047 160/238
2008/0252091 A1 * 10/2008 Edwards ..... B60R 7/043 296/37.15
2009/0096238 A1 * 4/2009 Misch ..... B60J 7/20 296/37.1
2009/0218847 A1 * 9/2009 Hespeler ..... B60P 3/36 296/162
2011/0155024 A1 * 6/2011 McCaffrey ..... B60N 3/004 108/26
2012/0091745 A1 * 4/2012 Cha ..... B60R 5/047 296/37.16
2012/0235451 A1 * 9/2012 Hrdlicka ..... B60R 7/043 297/188.2
2012/0291198 A1 * 11/2012 Hora ..... A47C 7/62 5/120
2013/0161364 A1 * 6/2013 Tirrell ..... B60R 7/02 224/275
2014/0109834 A1 * 4/2014 Hora ..... A01K 1/0353 119/28.5
2014/0284414 A1 * 9/2014 Nakatsuka ..... B60R 5/047 242/371
2014/0346268 A1 * 11/2014 Feldstein ..... B65H 75/4439 242/397.5
2015/0001874 A1 * 1/2015 Maier ..... B60R 5/045 296/37.16
2015/0020981 A1 * 1/2015 Weissmann ..... B62D 25/12 160/273.1
2015/0343954 A1 * 12/2015 Shin ..... B60R 5/047 296/24.43
2015/0375683 A1 * 12/2015 Signoretto ..... E06B 9/42 296/24.43
2017/0106801 A1 * 4/2017 Morlet Ugalde ..... B60R 5/047
2018/0340339 A1 * 11/2018 Burnside ..... A47G 27/0206

* cited by examiner

RETRACTABLE FLOOR COVER

CROSS REFERENCE TO RELATED APPLICATIONS

This application claims the benefit of U.S. Provisional Application No. 62/510,556 filed on May 24, 2017. The above identified patent application is herein incorporated by reference in its entirety to provide continuity of disclosure.

BACKGROUND OF THE INVENTION

The present invention relates to protective floor covers. More specifically, the present invention provides a retractable floor cover that includes a housing integral or securable to an object such as a furniture leg, wherein the retractable floor cover includes a flexible panel that can be selectively deployed to cover an area of flooring in order to prevent stains or other messes thereon.

Floors within a home or other dwelling often collect dirt, stains, debris, and other undesirable materials. It can be difficult to maintain a clean carpet, hardwood, tile, or other floor surface within a home. Foods, drinks, and other items often accidentally fall to the floor and require immediate cleaning in order to prevent or at least minimize dirtying or staining of the floor surface. If a stained surface is not quickly cleaned, permanent damage may occur to the surface, and such damage may be costly and time consuming to repair. Stained or dirty floors become a greater problem in common areas of the home, such as a living room where individuals often gather for recreation and social interaction, since stains there are more likely to occur due to the accidental spillage of foods, beverages, and the like.

One method of preventing a material from staining a particular floor surface is to cover the floor surface with a pad, plastic cover, or similar floor cover that can receive any potentially staining material. However, such floor covers are often bulky and difficult to handle due to the size of the area to be covered. These types of floor covers typically lack fasteners for securing the cover in place, and as such may be accidentally slid away from the desired area to be covered. Further, typical floor covers for preventing stains can be unappealing looking and detract from the overall aesthetic appeal of the room in which they are present. Therefore, it is desirable to provide a floor cover that can be extended to cover an area of flooring to prevent dirtying or staining thereof, which can also be retracted to a hidden position when the floor cover is not needed.

In light of the devices disclosed in the known art, it is submitted that the present invention substantially diverges in design elements from the prior art and consequently it is clear that there is a need in the art for an improvement to existing floor covering devices. In this regard the present invention substantially fulfills these needs.

SUMMARY OF THE INVENTION

In view of the foregoing disadvantages inherent in the known types of floor covers now present in the prior art, the present invention provides a retractable wherein the same can be utilized for providing convenience for the user when selectively covering an area of flooring in order to prevent stains or other messes from forming thereon. The present retractable panel includes an elongated cylindrical housing including a first end and an opposing second end. A flexible panel includes a first end connected to a rotatable spool disposed within an interior volume of the housing and a second end extending outwardly through a slot disposed on the housing, wherein the panel is configured to move between an extended position and a retracted position. A spring-rewind mechanism is disposed within the housing and operably connected to the rotatable spool. A control, such as a depressible button, is disposed on an exterior surface of the housing, wherein the control is in operable communication with the spring-rewind mechanism.

Actuation of the control is configured to activate the spring-rewind mechanism, wherein activation of the spring-rewind mechanism is configured to rotate the rotatable spool. Rotation of the rotatable spool is configured to roll the panel along the spool and retract the panel through the slot and into the interior volume of the housing. In one embodiment, the housing is integral to an article of furniture, such as a couch, chair, bed, or the like. In another embodiment, the housing includes a first strap disposed on the first end of the housing and a second strap disposed on the second end of the housing are each configured to removably secure the housing to an object, such as a couch or chair leg, for example. The panel can be selectively deployed to the extended position in order to cover a desired area of floor. The panel can be selectively retracted into the housing and obscured from view under a couch, chair, or other type of furniture when the panel is not needed.

Other objects, features, and advantages of the present invention will become apparent given the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
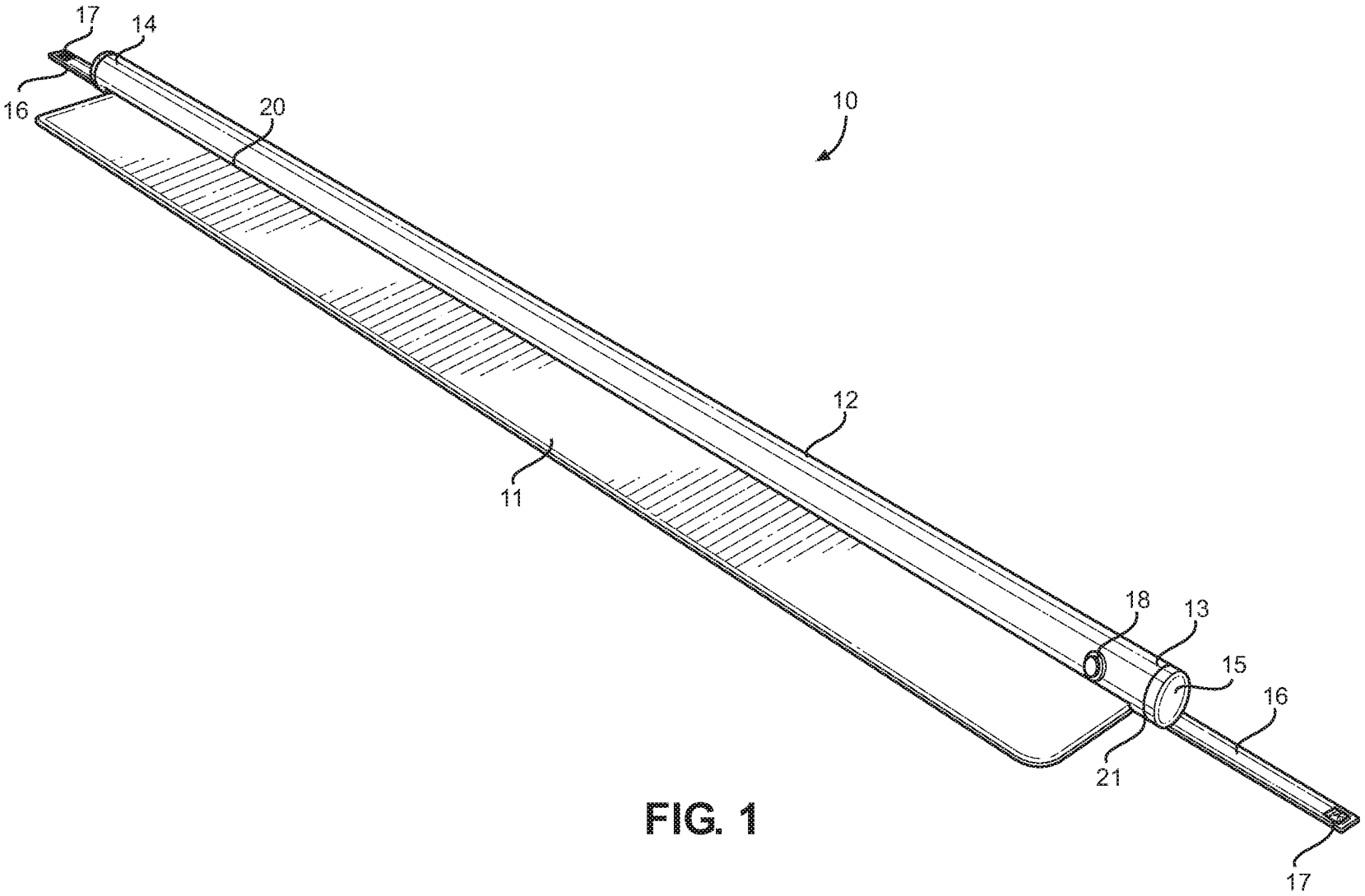
FIG. 1 shows a perspective view of an embodiment of the retractable floor cover.

Reference is made herein to the attached drawings. Like reference numerals are used throughout the drawings to depict like or similar elements of the retractable floor cover. For the purposes of presenting a brief and clear description of the present invention, the preferred embodiment will be discussed as used for selectively covering an area of a floor surface in order to prevent stains and other messes from occurring on the floor surface. The figures are intended for representative purposes only and should not be considered to be limiting in any respect.

Figure 2:
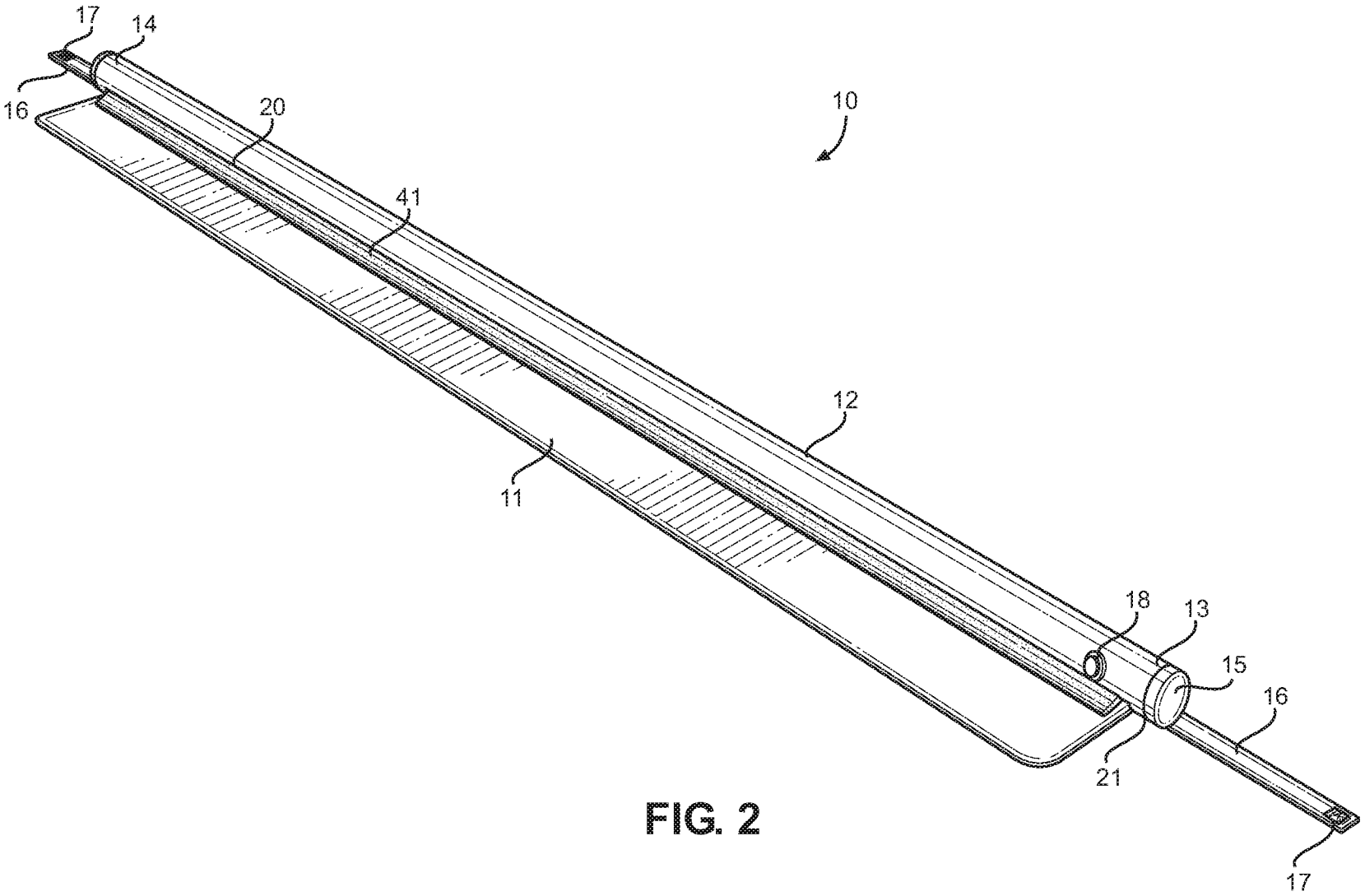
FIG. 2 shows a perspective view of an alternate embodiment of the retractable floor cover.

Referring now to FIGS. 1 and 2, there is shown a perspective view of an embodiment of the retractable floor cover and a perspective view of an alternate embodiment of the retractable floor cover, respectively. The retractable floor cover 10 includes an elongated cylindrical housing 12 including a first end 13 and a second end 14 defining an interior volume therebetween. In alternate embodiments, the housing 12 can include alternate shapes, such as rectangular, for example. A flexible panel 11 includes a first end affixed to a rotatable spool disposed within the interior volume of the housing 12. A second end of the panel 11 extends outwardly through a slot 20 disposed on the housing 12. In the shown embodiment, the slot 20 extends partially between the first and second ends 13, 14 of the housing 12, such that a space is defined between a side edge of the slot 20 and a side face 15 of the housing 12. In alternate embodiments, the slot 20 extends the entire length between the first and second ends 13, 14 of the housing 12, such that a side edge of the slot 20 is coterminous with a side face 15 of the housing 12.

The rotatable spool is operably connected to a spring-rewind mechanism which is also disposed within the interior volume of the housing 12. The spring-rewind mechanism is operably connected to a control 18 disposed exteriorly on the housing 12. In the shown embodiment, the control 18 comprises a depressible button that is configured to be biased towards a raised, undepressed position. Actuation of the control 18 is configured to cause simultaneous activation of the spring-rewind mechanism, which in turn is configured to rotate the rotatable spool. Rotation of the rotatable spool is configured to roll the panel 11 therealong and retract the panel 11 through the slot 20 and into the housing 12. In one embodiment, the spring-rewind mechanism includes a dampener, such that the spool is prevented from exceeding a threshold rotational speed. The dampener prevents uncontrolled or excessively quick retraction of the panel 11, thereby increasing user safety.

In the embodiment shown in FIG. 2, the housing 12 further includes a wiper 41 disposed above the slot 20 and extending along the length of the housing 12. The wiper 41 may be composed of rubber or any other suitable material. In one embodiment, the wiper 41 is flexible. In an alternate embodiment, the wiper 41 is rigid. The wiper 41 is configured to contact an upper surface of the panel 11 and thereby scrape any debris off of the panel 11 as the panel is retracted through the slot 20 and into the housing 12.

When in a fully retracted position, a portion of the panel 11 remains outside of the housing 12, such that an individual may easily grasp the panel 11 and pull it out of the housing when deploying the panel 11 to an extended configuration. The spring-rewind mechanism is configured to lock and maintain the panel 11 in a desired position when the panel 11 is pulled through the slot 20. In alternate embodiments, the panel 11 may comprise a handle thereon for facilitating grasping and handling of the panel 11.

In the shown embodiment, a strap 16 is disposed on each of the first and second ends 13, 14 of the housing 12. The straps 16 are composed of a flexible material, and each strap 16 includes a fastener 17 thereon that is configured to secure the strap 16 to an object, such as a leg of a couch or chair, for example. In the shown embodiment, the straps 16 are each affixed to a lower side 21 of the housing 12, such the straps 16 are oriented orthogonal to the side faces 15 of the housing, allowing objects such as chair or couch legs to be supported on the upper planar surface of the straps 16. In the shown embodiment, each fastener 17 comprises a hook and loop fastener. In alternate embodiments, other suitable fasteners 17 may be utilized, such as snaps, buckles, buttons, or the like. In alternate embodiments, the housing 12 may be integral to an article of furniture, such as a couch, chair, bed, or the like.

Figure 3B:
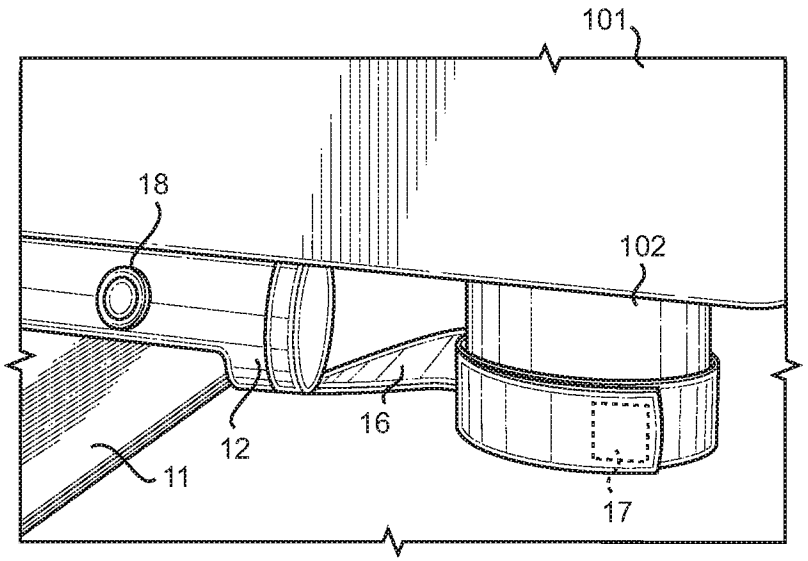
FIG. 3B shows a perspective view of an embodiment of the retractable floor cover secured to a furniture leg in a second configuration.
Figure 3A:
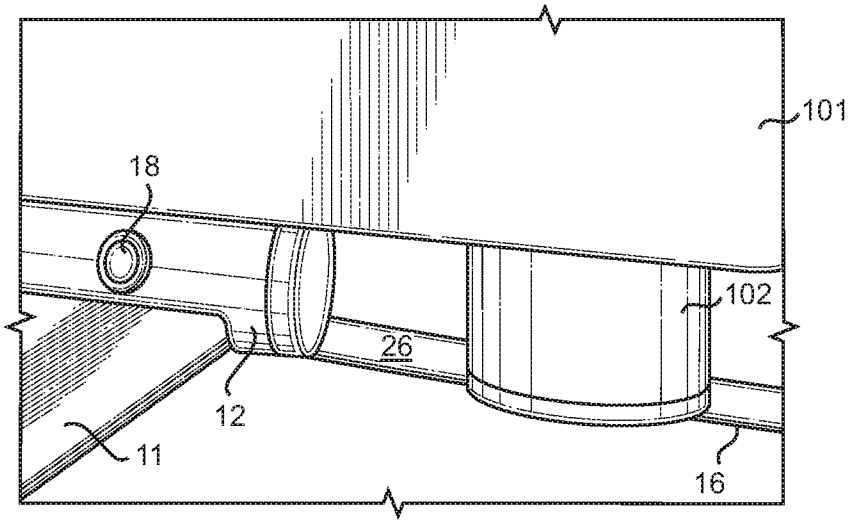
FIG. 3A shows a perspective view of an embodiment of the retractable floor cover secured to a furniture leg in a first configuration.

Referring now to FIGS. 3A and 3B, there is shown a perspective view of an embodiment of the retractable floor cover secured to a furniture leg in a first configuration and a perspective view of an embodiment of the retractable floor cover secured to a furniture leg in a second configuration, respectively. The housing 12 can be secured to an object such as the leg 102 of a couch 101. In FIG. 3A, the leg 102 is shown being supported on the planar upper surface 26 of the strap 16, such that unwanted movement of the housing 12 is prevented thereby. In FIG. 3B, the strap 16 is shown wrapped around the leg 102 and secured thereto via the fastener 17, which provides enhanced securement and stability of the housing 12, further preventing unwanted movement thereof when the panel 11 is pulled out of the housing 12. In some embodiments, the straps 16 are configured to be adjustable in length via a slide lock mechanism or other length adjustment mechanism, allowing the straps 16 to be secured around different sized objects, such as furniture legs having different diameters. In an alternate embodiment, the straps 16 can be monolithic or integral with a portion of the article of furniture, such as the leg 102 thereof. In another alternate embodiment, the housing 12 can be integral to a frame or other portion of an article of furniture.

The straps 16 and slot are positioned on the housing such that the control 18 is easily accessible through the gap defined by a lower end of the furniture body and the floor surface. In the shown embodiment, the control 18 is disposed proximal to the slot, which allows the control to be easily reached. In other embodiments, the control 18 is disposed on alternate portions of the housing 12, such as an end face thereof, which would obscure the control 18 and prevent the control 18 from being accidentally kicked and actuated when activation of the spring-rewind mechanism is undesired.

Figure 4:
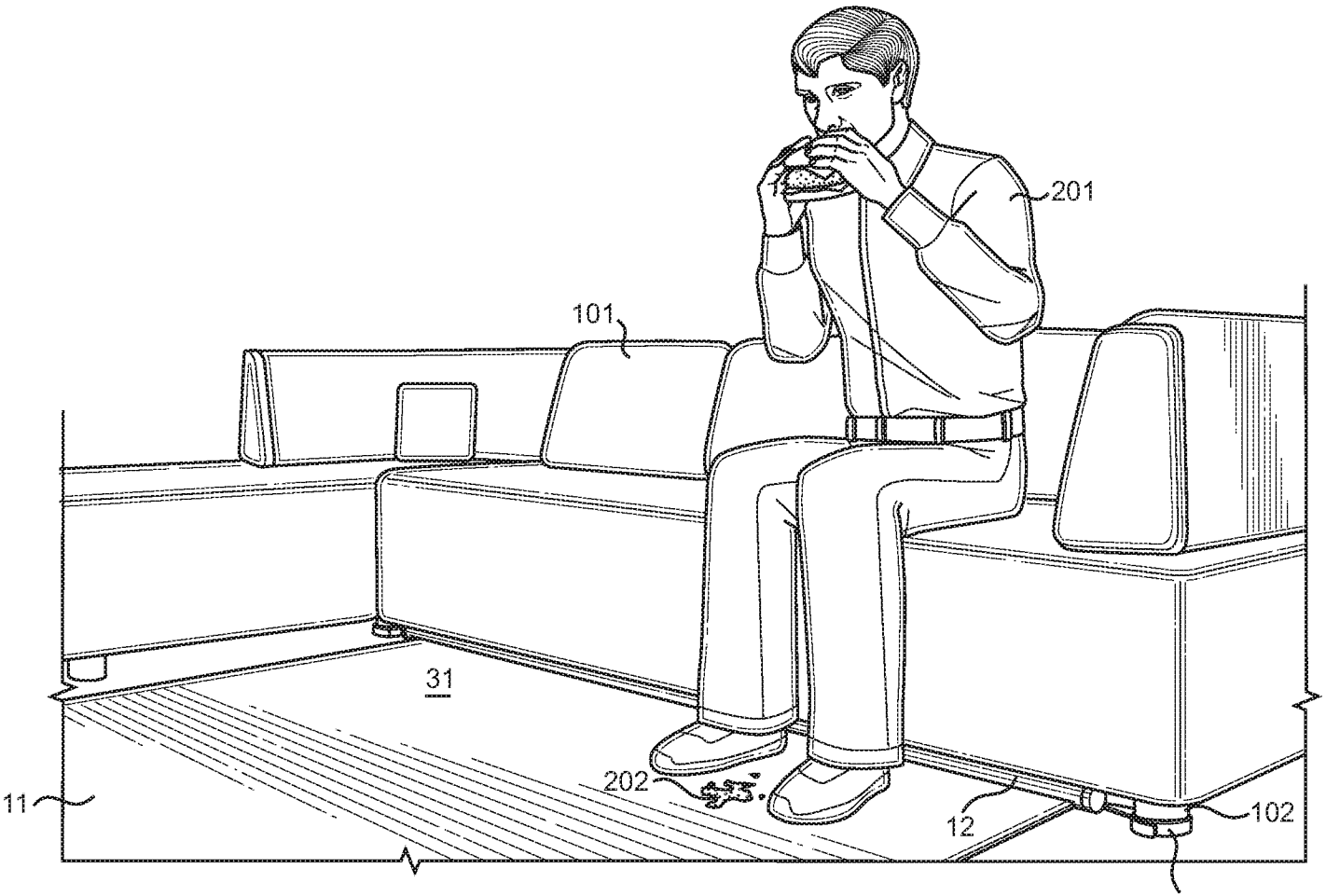
FIG. 4 shows a perspective view of an embodiment of the retractable floor cover in use.

Referring now to FIG. 4, there is shown a perspective view of an embodiment of the retractable floor cover in use. In operation, the housing 12 is secured to an object such as a leg 102 of a couch 101 via the strap 16, thereby securing the housing 12 in place and preventing unwanted movement thereof. The panel 11 can be selectively deployed to cover an area of a floor surface, such that the upper surface 31 of the panel 11 receives particles 202 accidentally dropped by an individual 201, such as food, dirt, liquids, or any other particles 202 that would have to be otherwise cleaned or removed from the floor surface. When non-messy activities are taking place, or when the panel 11 is otherwise desired to be removed, the control can be actuated to automatically retract the panel 11 into the housing 12, which is hidden beneath the couch 101, preventing detraction from the room's appearance.

In one embodiment, the panel 11 includes an absorbent material that is configured to absorb liquid spills. In another embodiment, the panel 11 includes a hydrophobic material, such that liquid spills bead up on the upper surface 31 of the panel 11 where they can be easily absorbed and removed with an absorbent cleaning device such as a sponge, paper towel, or the like. In yet another embodiment, the panel 11 includes a lower surface including a material having a coefficient of friction greater than one, which helps prevent the panel 11 from accidentally sliding along the floor to an unwanted position. Overall, the retractable floor cover provides a selectively extendable panel that can be used to cover a desired are of floor surface to prevent staining or other dirtying of the floor surface.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A retractable floor cover, consisting of:

an elongated cylindrical housing including a first end and an opposing second end;

a flexible panel including a first end connected to a rotatable spool disposed within an interior volume of the housing and a second end extending outwardly through a slot disposed on the housing, wherein the panel is configured to move between an extended position and a retracted position;

a spring-rewind mechanism disposed within the housing and operably connected to the rotatable spool;

a control disposed on an exterior surface of the housing, the control in operable communication with the spring-rewind mechanism, wherein the control is configured to activate the spring rewind mechanism when actuated, wherein the spring rewind mechanism is configured to rotate the rotatable spool when activated, wherein the rotatable spool is configured to roll the panel along the spool and retract the panel through the slot and into the interior volume of the housing when the rotatable spool rotates;

a first strap disposed on the first end of the housing and a second strap disposed on the second end of the housing, wherein the first strap and the second strap are each affixed to a lower side of the housing and configured to removably secure the housing to an object;

wherein each of the first strap and the second strap is oriented orthogonal to a side face of the housing;

wherein each of the first strap and the second strap consists of a flexible member having a planar upper surface and a fastener disposed thereon.

* * * * *